US012018837B2

(12) United States Patent
Rajewski

(10) Patent No.: US 12,018,837 B2
(45) Date of Patent: Jun. 25, 2024

(54) FLARE STACK DIFFUSER TIP

(71) Applicant: Prism Integrated Solutions Inc., Forestburg (CA)

(72) Inventor: Cal Robert Rajewski, Donalda (CA)

(73) Assignee: Prism Integrated Solutions Inc., Forestburg (CA)

( * ) Notice: Subject to any disclaimer, the term of this patent is extended or adjusted under 35 U.S.C. 154(b) by 311 days.

(21) Appl. No.: 17/388,513

(22) Filed: Jul. 29, 2021

(65) Prior Publication Data

US 2022/0034506 A1 Feb. 3, 2022

(30) Foreign Application Priority Data

Jul. 29, 2020 (CA) ..... CA 3088318

(51) Int. Cl.
*F23G 7/08* (2006.01)

(52) U.S. Cl.
CPC ..... *F23G 7/085* (2013.01); *F23G 2209/14* (2013.01)

(58) Field of Classification Search
CPC ..... F23G 7/085; F23G 2209/14
USPC ..... 431/202
See application file for complete search history.

(56) References Cited

U.S. PATENT DOCUMENTS

RE27,507 E 10/1972 Turpin
3,797,991 A 3/1974 Straitz, III
4,140,471 A 2/1979 Straitz, III et al.
4,486,168 A 12/1984 Pratley
5,865,613 A 2/1999 Rajewski
6,840,760 B1 1/2005 Keller et al.
7,354,265 B2 4/2008 Mashhour et al.
7,789,659 B2 * 9/2010 Godon ..... F23D 14/84 431/351
2010/0291429 A1 11/2010 Poe et al.
2016/0138805 A1 * 5/2016 Martin ..... F23D 14/045 431/354

OTHER PUBLICATIONS

Calliidus Technologies, LCC, Advancing flare technology, Brochure, Nov. 2014, 4 pages, US.
Aereon, Flare Systems, Pamphlet, at least as early as Mar. 3, 2020, 2 pages.
Flaretech, FlareTech S.L. Air Assisted Flare Tip, Product webpage, at least as early as Mar. 2, 2020, 1 page.
John Zink Hamworthy, Air-Assisted Flares, Brochure, 2019, 4 pages, Tulsa, OK.
Buzzer, Radial Burner, Product webpage, at least as early as Dec. 18, 2019, 1 page.
Tornado Technologies Inc., Combustion Projects, Webpage, at least as early as Mar. 2, 2020, 4 pages.
Tornado Technologies Inc., Brochure, at least as early as Mar. 2, 2020, 12 pages.

(Continued)

*Primary Examiner* — Vivek K Shirsat
(74) *Attorney, Agent, or Firm* — Colby Nipper PLLC

(57) ABSTRACT

There is a flare stack diffuser tip for use with a flare stack having a waste gas conduit. The flare stack diffuser tip has one or more concentric diffuser rings. One or more radial transfer spokes connect to the waste gas conduit of the flare stack to receive waste gas. The one or more radial transfer spokes is in fluid connection with the one or more concentric diffuser rings.

9 Claims, 11 Drawing Sheets

(56) References Cited

OTHER PUBLICATIONS

Mazen, M., et al., New Technology: Saudi Aramco High Pressure Air Assist System (HPAAS) for Upgrading Existing Flares to Smokeless Combustion, International Flame Research Foundation 16th Members Conference, Jun. 8-10, 2009, Boston, 1-14.
Custom Pipe Burners, Radial Spoke Pipe Burners, Product webpage, at least as early as Jan. 6, 2020, 8 pages.

* cited by examiner

FLARE STACK DIFFUSER TIP

TECHNICAL FIELD

Flare Stack Diffuser Tips.

BACKGROUND

In the oil and gas industry there are conditions that require the venting or combustion of waste gases from the production process. Combustion of the waste gases is done through devices called flare stacks. These flare stacks are elevated pipes standing vertically in the air to combust the waste gas at an elevation that is safe for toxic gas dispersion of unburnt gases and high enough that the flare does not ignite ground-level flammable items or present a high risk to the personnel operating the facilities. The conditions in which flare stacks operate are very harsh and challenging. Temperatures may range from extreme cold to extreme heat in a very short time. Flaring at the flare tip may cause materials to deteriorate due to the presence of high temperatures, hydrogen sulphide, windy, wet and/or oily conditions. Inefficient flare tips can cause issues such as increased carbon footprints, increased smoke production and incomplete combustion of waste gases. Flare stacks have to provide reliable ignition, cross-lighting and flame stability to ensure complete combustion of waste gases at both high and low flow rates.

Radial slot air assisted flare stack tips utilize high velocity air which mixes with the diffused waste gas stream to support complete combustion. A problem with existing designs is maintaining ignition of all the individual slots at flows less than the maximum design case. When these low flows are combined with a crosswind the individual slots on the upwind side can be snuffed out by the wind and will fail to reignite allowing the release of unburnt gas. A cause of this ignition failure can be a wall of air wedged between gas streams being released by the radial slots. In some cases, modifications of the radial systems such as the addition of a ring burner and flame retention tabs are required to compensate for this deficiency.

Radial slot style tips may release air in a wedge shape that lowers the amount of air being supplied to the core while at the same time the gas is becoming more concentrated as you move towards the center of the flare. The radial slot style tips also generally have a capped core which results in the fuel/air mixture being pulled down into the center of the stream further concentrating the excess gas in the core of the flare. This can cause incomplete combustion which results in soot formation which presents itself as dark orange flames and smoke in the center of tips built with this design. This incomplete combustion also releases unburnt greenhouse gases or gases that pose health risks to people and livestock in the area.

SUMMARY

There is provided a flare stack diffuser tip for use with a flare stack having a waste gas conduit. The flare stack diffuser tip uses continuous diffuser rings to introduce the waste gas into the air stream. There is a minimum of one ring, additional rings are added as required by the assist air requirements of the waste gas composition to be combusted. There are one or more radial transfer spokes configured to connect to the waste gas conduit to receive waste gas. These spokes have a flame bridge built on the top of them when two or more concentric rings are required. This flame bridge is positioned below the flare tip ignition system and performs the critical role of cross-lighting the rings by ensuring all waste gas release points are contiguous. The one or more radial transfer spokes are in fluid connection with the concentric diffuser rings.

Using an uninterrupted ring ensures all released waste gas will be ignited and burnt without the extra complexity or burning of additional fuel gas that the ring burner utilized in radial slot style tips can require to maintain stable ignition and cross-lighting of the individual slots.

In various embodiments, there may be included any one or more of the following features. The radial transfer spokes define an open core permitting air flow through a central opening defined by a concentric diffuser ring. The one or more radial transfer spokes each extend upwardly and outwardly at an upper end of the flare stack waste gas conduit to define the open core. When two or more concentric diffuser rings are used they define air flow passageways between them. The air flow passageways connect to the open core. As the waste gas conduit increases in diameter the quantity of radial transfer spokes increases. The radial transfer spokes will be equally angularly-spaced from each other. Multiple waste gas streams can be configured in a single tip. An example of this would be a three concentric ring tip that would use an inner and outer ring to dispose of waste gas A while an intermediate ring would dispose of waste gas B. Waste streams A and B will exit a single tip but will never be combined. Another application for this configuration is to have the inner and outer rings dispose of low BTU waste gas while the intermediate ring burns fuel gas to sufficiently raise the combustion temperature of waste gas A so it burns completely. A multi-ring tip may employ fuel gas driven flame bridges in applications where the flare is not operating with a continuous purge gas flow.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Figure 1:
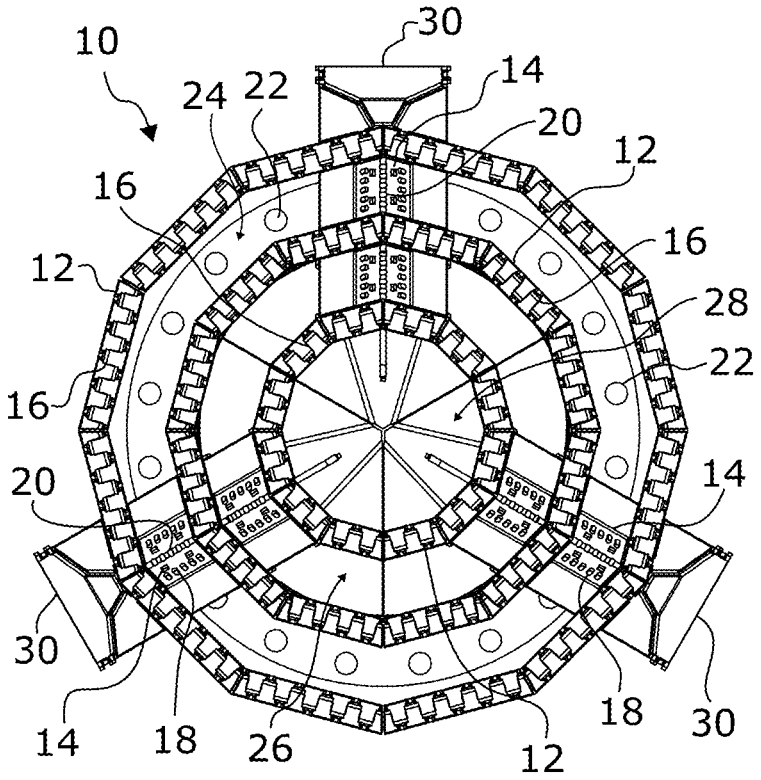
FIG. 1 is a top view of an embodiment of a flare stack diffuser tip without the outer air annulus tip shown.

FIGS. 1-7 show a flare stack diffuser tip 10 for use with a flare stack (not shown) having a waste gas conduit (not shown) and air assist annulus/duct (not shown). As shown in FIG. 1, there are three concentric diffuser rings 12. In the embodiment shown in FIGS. 8 and 9, there are two concentric diffuser rings 112. The flare stack diffuser tips described herein may have at least one diffuser rings 12. Depending on the size of the flare stack and the amount of waste gas anticipated, more than three concentric diffuser rings may be used.

Connected to the concentric diffuser rings 12 are radial transfer spokes 30 configured to connect to the waste gas conduit of the flare stack to receive waste gas. The radial transfer spokes 30 are in fluid connection with the concentric diffuser rings 12. As shown in FIG. 1, there are three radial transfer spokes. In the embodiment shown in FIGS. 8 and 9, there are six radial transfer spokes 114. In the embodiments disclosed, there may be one or more radial transfer spokes. The number of radial transfer spokes may be chosen depending on the particular application. Top portions 14 of the radial transfer spokes 30 include apertures 18 to act as a flame bridge 40 to enable plural rings to be ignited with a single ignition source (not shown).

Figure 5:
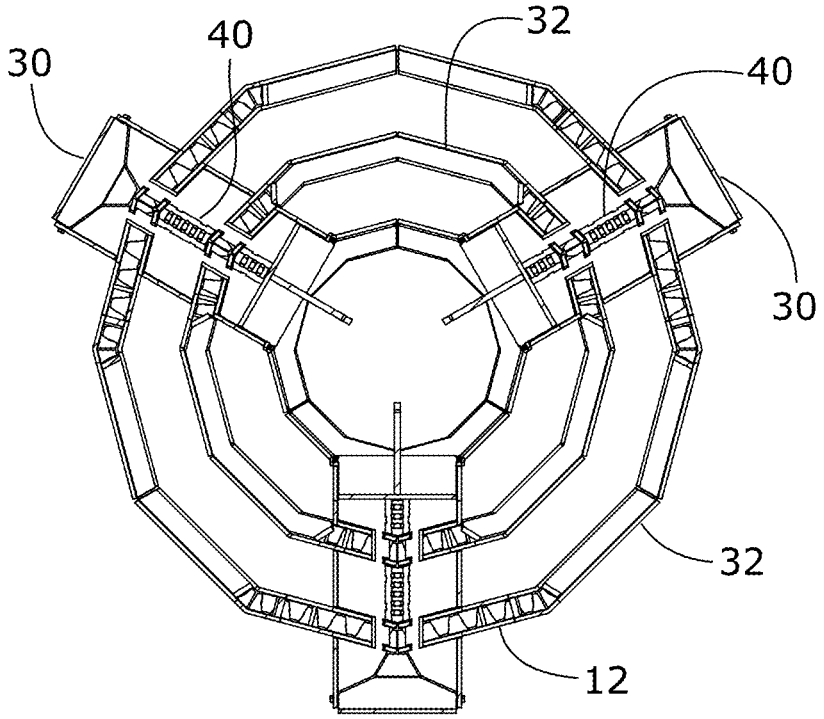
FIG. 5 is a section view through the section B-B of FIG. 3.
Figure 6:
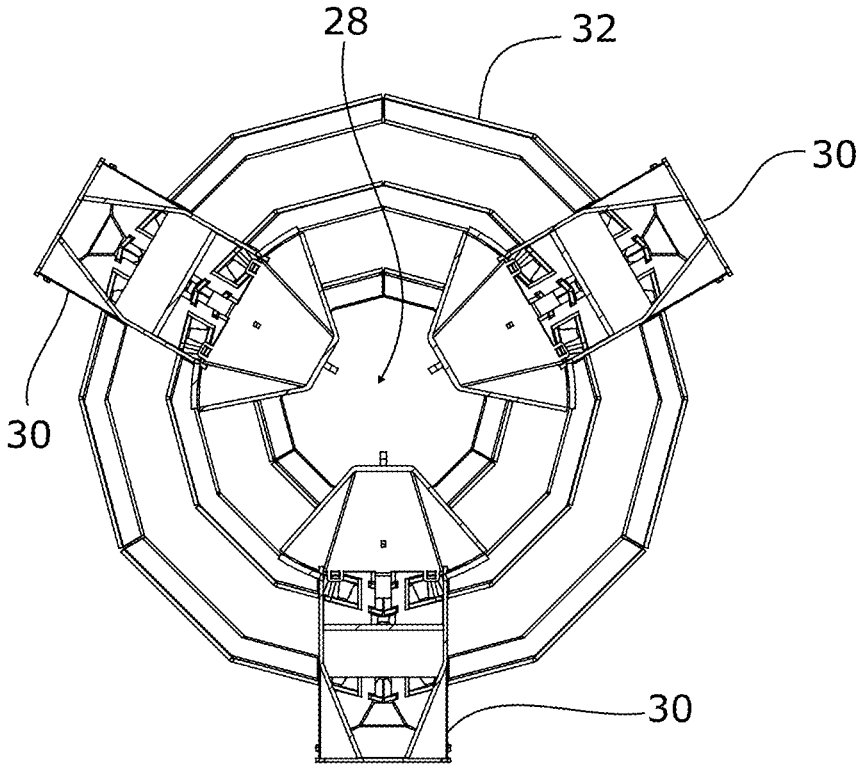
FIG. 6 is a section view through the section C-C of FIG. 3.

The radial transfer spokes 30 define an open core 28 permitting air flow through a central opening defined by the concentric diffuser rings 12. As shown in FIG. 5, each of the transfer spokes 30 have a flame bridge 40. Having one flame bridge 40 for each transfer bridge allows for redundancy in case one of the flame bridges fails to ignite the adjacent ring. It is possible to operate the system with a different number of flame bridges, including only one if the flame bridge is sufficiently dependable. The flame bridge operates using either waste gas or purge gas that is supplied through the waste gas conduit. An alternative configuration uses a fuel gas driven flame bridge when a sufficient purge gas flow isn't available or desirable.

Figure 2:
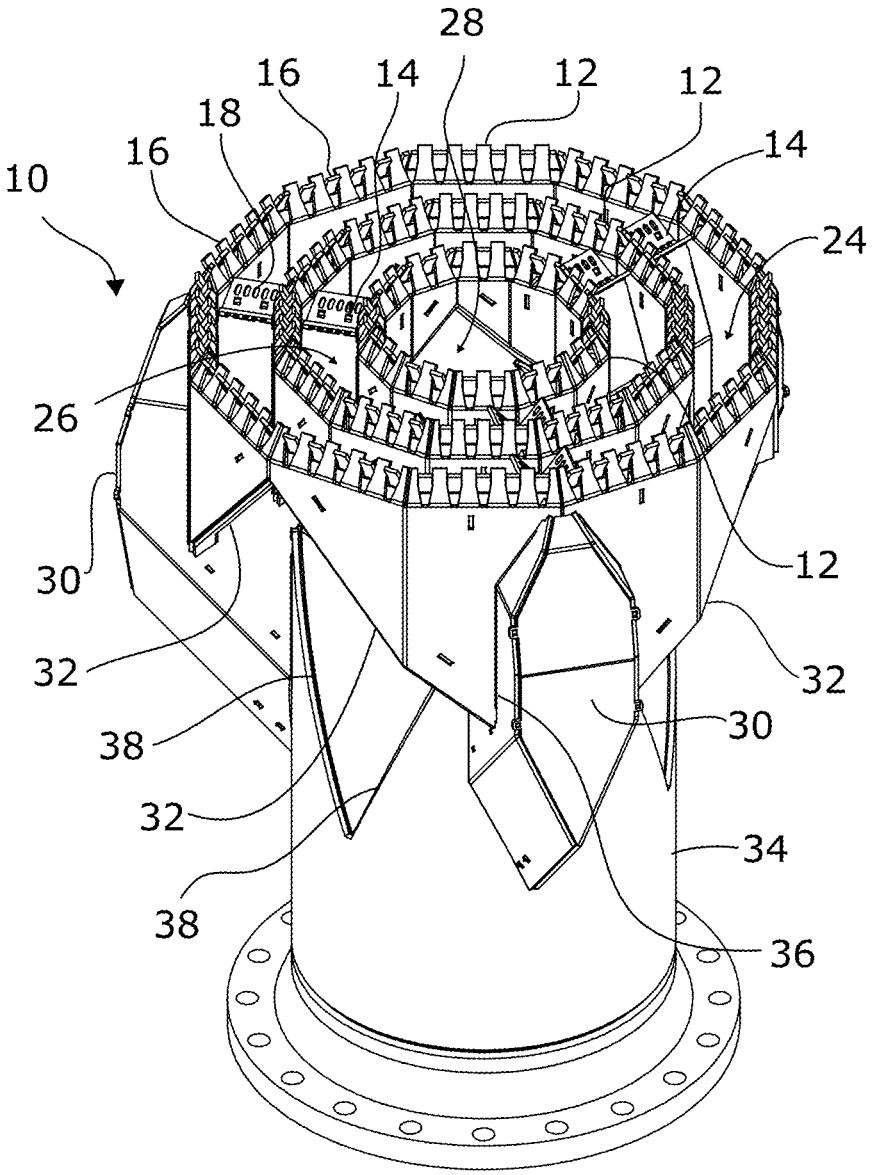
FIG. 2 is a side isometric view of the flare stack diffuser tip of FIG. 1.
Figure 3:
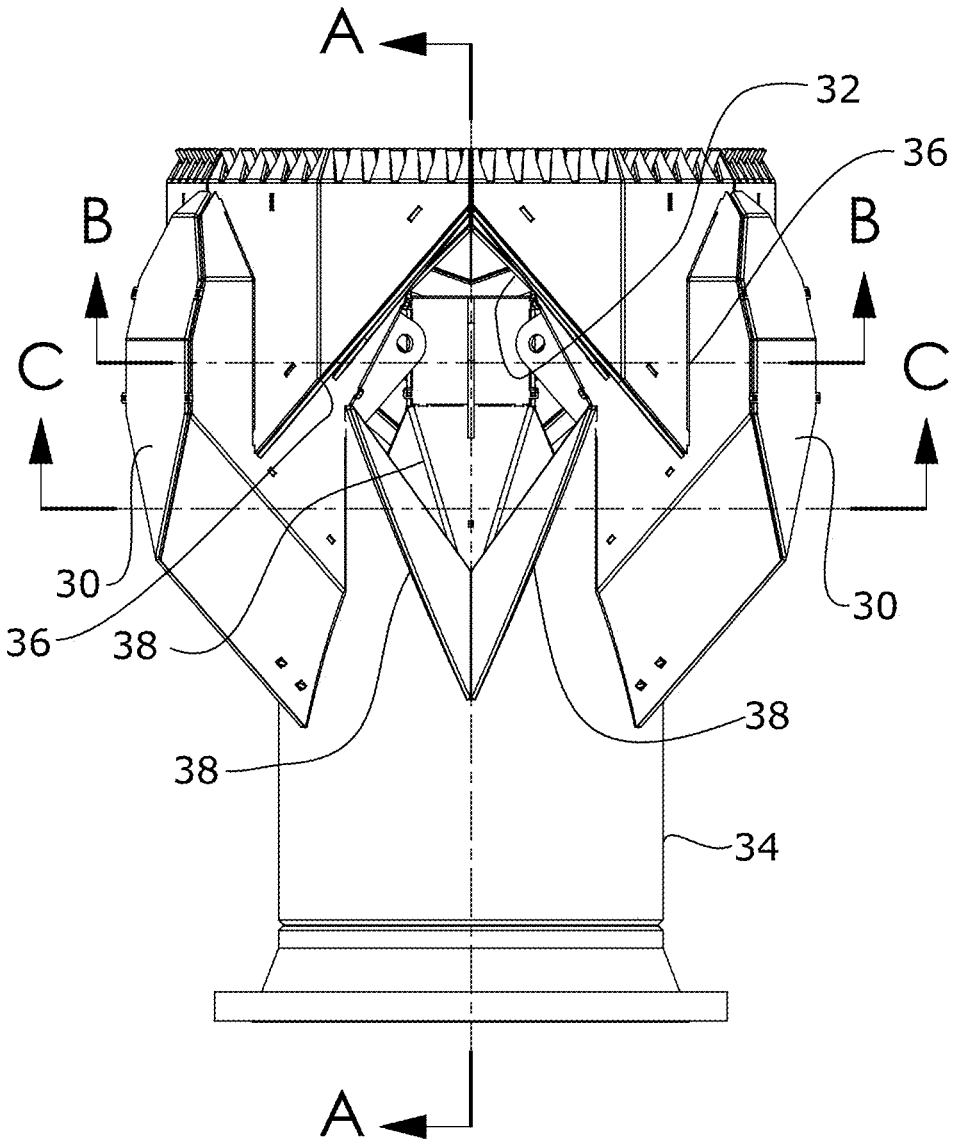
FIG. 3 is a side view of the flare stack diffuser tip of FIG. 1.
Figure 4:
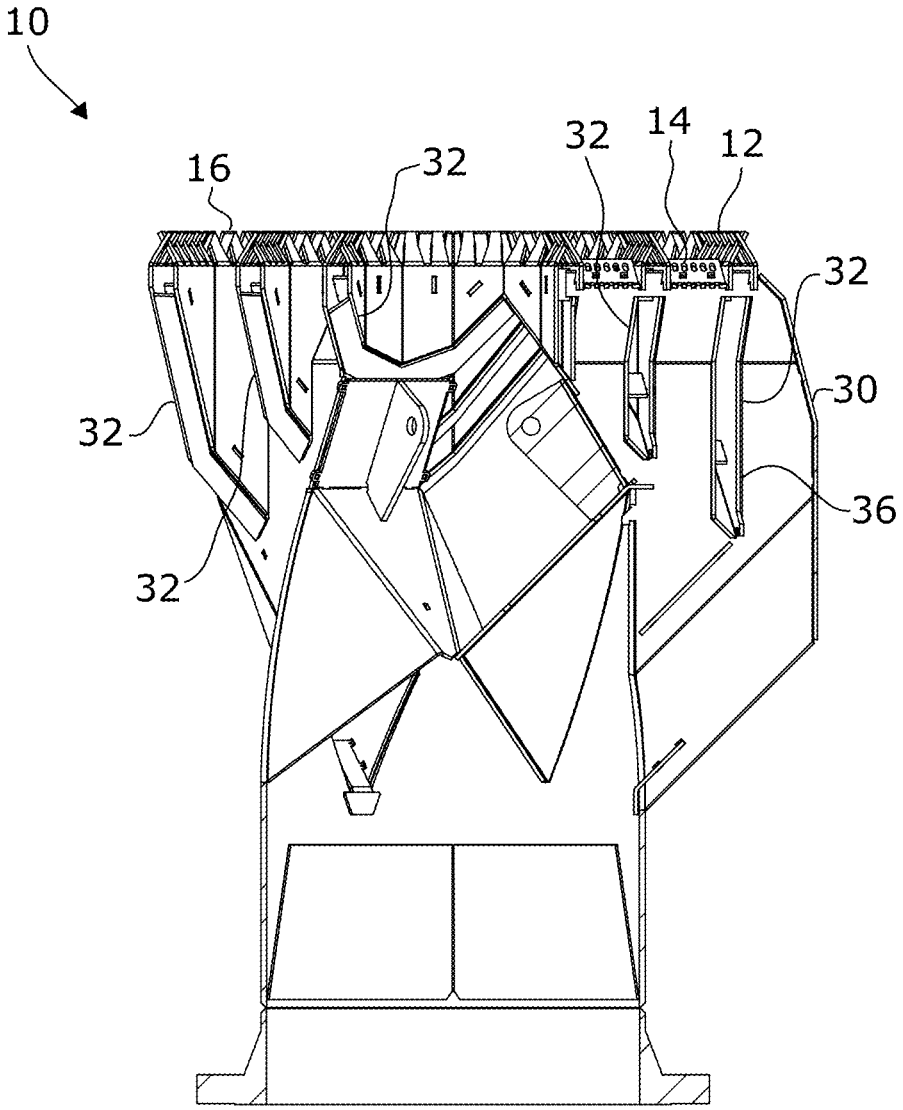
FIG. 4 is a section view through the section A-A of FIG. 3.

The concentric diffuser rings 12 have a plurality of diffuser tabs 16 at the top. As shown in FIGS. 2 and 3, the diffuser tabs are interlaced teeth extending from either side of each of the concentric diffuser rings 12. Various designs of diffuser tabs 16 may be used. These diffuser tabs 16 can be integral to the concentric diffuser ring 12 or separate and therefore replaceable. Utilization of stand-alone diffuser tabs 16 allows the selective use of high performance metals or ceramics that would otherwise be impractical to use due to cost or difficulty in fabricating. The replaceable diffuser tabs 16 allow for low cost repairs of the tip where a portion must be replaced due to natural deterioration or if the process has changed and requires a modified gas flow. Typically these repairs are accomplished by replacing the entire tip which is a significant cost.

As shown in FIGS. 1 and 2, the top end of the radial transfer spokes 30 include a series of gas openings 20 that form the flame bridges 40 (FIG. 5). The number, size and shape of the gas openings may be changed depending on the application. The top end of the radial transfer spokes are a v-shaped design in this embodiment, meeting at the edge of the gas openings 20. As shown in the embodiments in FIGS. 8 and 9, the top end of the radial transfer spokes have a triangular-prism shape that end in an apex. Various different designs of the top end of the radial transfer spokes can be used.

Figure 7:
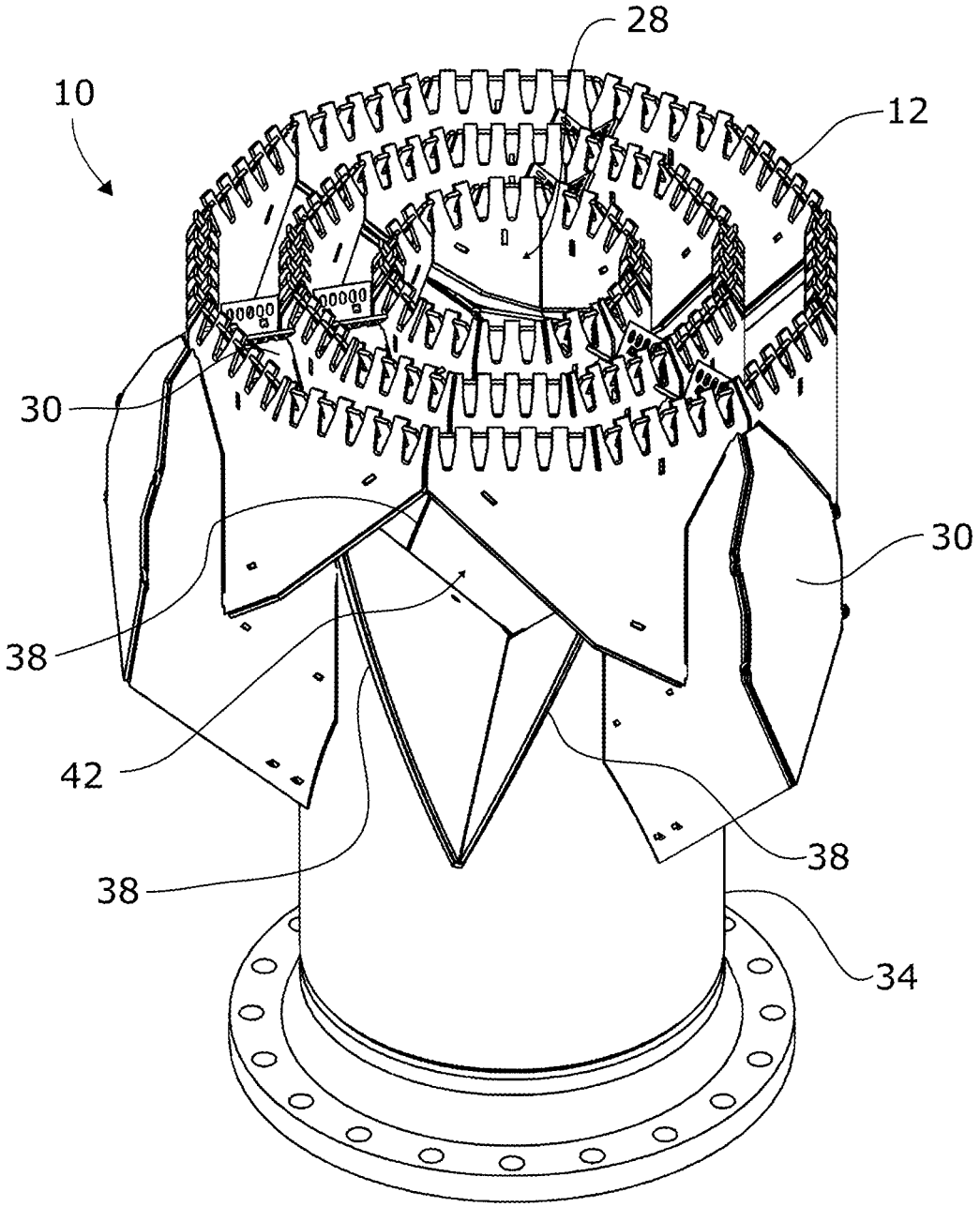
FIG. 7 is a side isometric view of the flare stack diffuser tip of FIG. 1.

As shown in FIG. 7, the radial transfer spokes 30 each extend upwardly and outwardly at an upper end of the flare stack diffuser tip to define the open core 28. The radial transfer spokes 30 extend upwardly from pipe 34 that connects to the waste gas conduit of the flare stack. The pipe 34 splits into equally divided but separate conduits 38 which connect into the radial transfer spokes 30. Alternatively, in some embodiments the pipe 34 may be split into conduits of unequal size or spacing. Upper conduits 36 extend from the radial transfer spokes 30, forming the concentric diffuser rings 12 at upper edges of the upper conduits. Lower edges 32 of the upper conduits 36 are higher as they move away from the radial transfer spokes 30 to form a triangular shape. There is an open area 42 above the conduits 38 which connects to the open core 28. As shown in FIG. 2, the concentric diffuser rings 12 define air flow passageways 24 and 26 between them which also connect to open area 42 as well as open core 28. The pipe 34 may be connected to the waste gas conduit of the flare stack using various conventional connections, such as bolts through bolt holes 22. An air annulus tip 144 (not shown in FIGS. 1-7 for clarity, but shown in FIGS. 8 and 9) largely encloses the bulk of flare stack diffuser tip 10.

As shown in FIG. 1, the three radial transfer spokes are each equally angularly-spaced from each other. Similarly, the three concentric diffuser rings 12 are each equally radially-spaced from each other. As shown in FIG. 1, the concentric diffuser rings each share a common central axis, but they may also be offset from each other. Different angular and radial spacing between the transfer spokes and concentric diffuser rings are possible depending on the application.

The flare stack diffuser tip allows for reliable and consistent cross lighting performance. In some embodiments, this prevents the release of unburnt hydrocarbons due to poor cross lighting performance of existing designs and eliminates the burning of extra hydrocarbons by not needing a ring burner to function.

Figure 8:
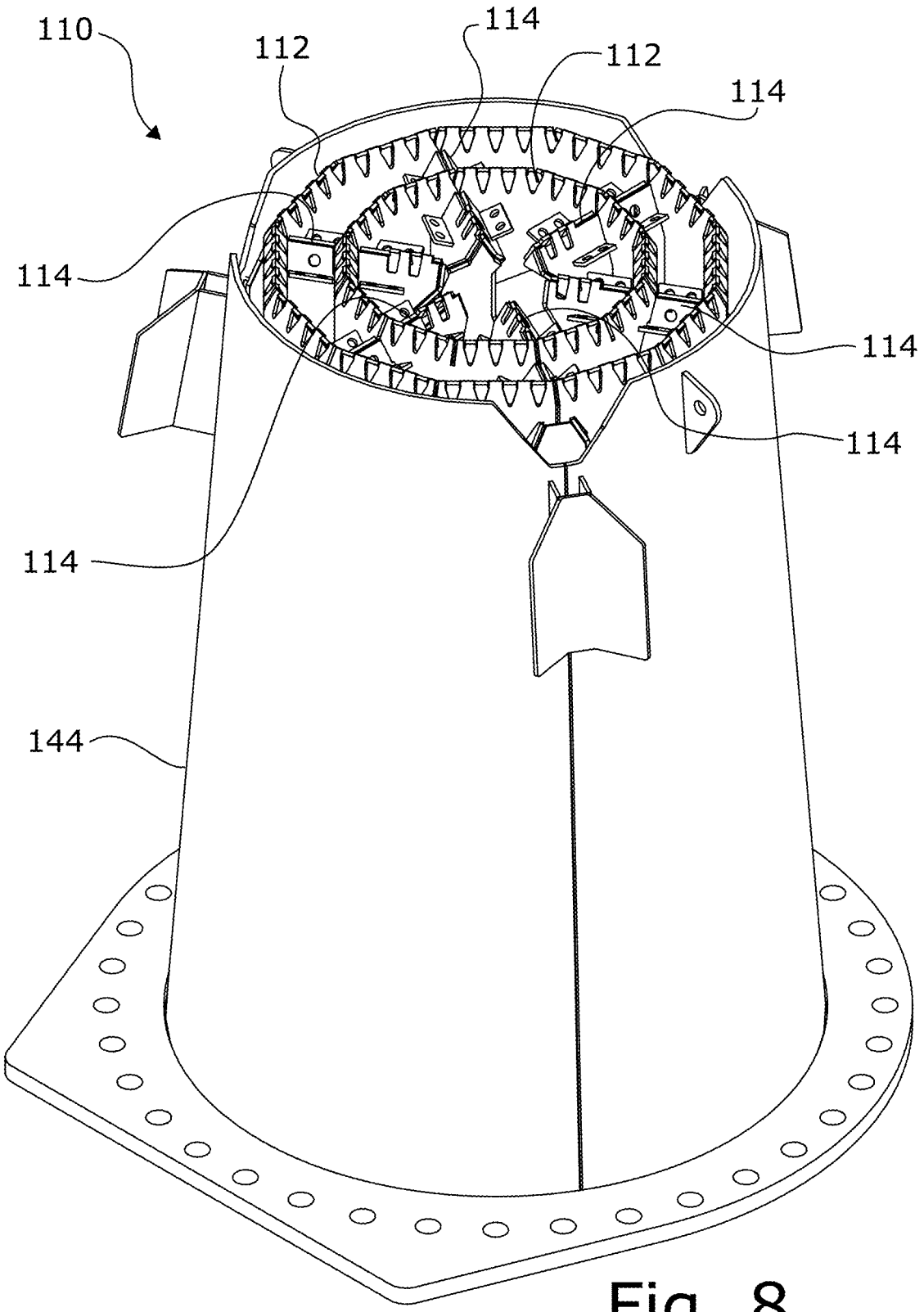
FIG. 8 is a side isometric view of another embodiment of a flare stack diffuser tip with the outer air annulus tip shown.
Figure 9:
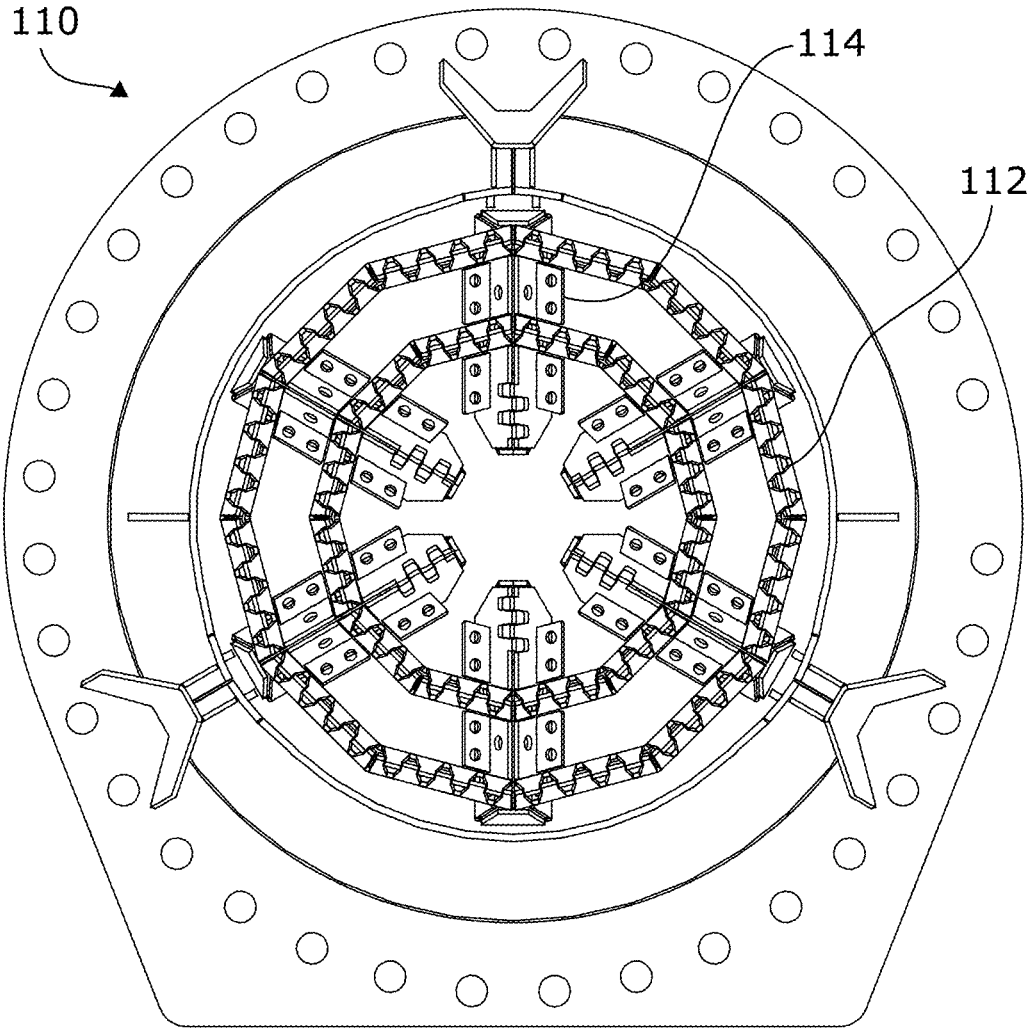
FIG. 9 is a top view of the flare stack diffuser tip of FIG. 8.

As shown in FIGS. 8 and 9, the flare stack diffuser tip 110 may light around the entire ring 112 and has six flame spokes 114 that allow the flame to bridge the rings by burning in between them which then lights the internal ring. Depending on the size of the flare, additional rings 112 may be added on the outside. An air annulus tip 144 largely encloses the remainder of flare stack diffuser tip 110. Air may be directed into the flare stack diffuser tip 110 through an air conduit (not shown).

Embodiments of the flare stack diffuser tips may provide for extra cross lighting and flame stability which in turn may provide for a much higher turn down rate so the tip can handle a larger volume of gas flows without compromising its performance under low flow conditions. Embodiments of the flare stack diffuser tip may also provide higher combustion efficiency, and better mixing due to a more laminar flow. By using a more laminar flow, the mixing can be controlled to a higher degree. A balanced flow may also be achieved due to consistent and tuneable spacing of flow passages as well as the ability to tune the size of the gas port formed by the diffusion tabs 16.

The flare stack diffuser tip alternates air and gas streams in concentric rings. This provides a more uniform mixture in a low pressure flare application. The air to gas ratio is consistent and controlled throughout the mixed streams. The flare stack diffuser tip has the open core 28 allowing the air stream to flow into it to keep the flows balanced. Embodiments of the flare stack diffuser tip provide reduced carbon footprints and reduced operating and construction costs in relation to convention designs of flare tips.

In some embodiments, the cross lighting performance eliminates the need for a ring burner which lowers the carbon foot print by eliminating the need to burn extra gas and all of the materials used to construct the ring burner and flame retention tabs.

A smaller tip size can be used due to better mixing conditions and the precise air/fuel gas ratios provided by the consistent ring spacing. With a smaller tip comes a reduction in air supply requirements which translates directly into lower energy usage. Benefits in flare tip design can also create benefits to the main structure of the flare stack. A smaller tip may allow the rest of the flare to be proportionately smaller which may result in fewer construction materials and less weight to transport so the carbon footprint is reduced.

The amount of space available for air to arrive in the core of the flare may be adjusted to improve the performance of the flare tip.

In some cases, replaceable tabs may be used for the diffuser tabs of the diffuser tip. The diffuser tab is considered a wear/sacrificial area of the tip. The diffuser tabs may be made from various materials, including ceramics, such as silicon nitride when extreme conditions require it. In some less extreme applications using replaceable diffuser tabs, the tabs may be made from a different material from the remainder of the flare stack diffuser tip. For example, the replaceable diffuser tabs may comprise SAE 310 stainless steel while other parts of the diffuser tip comprise SAE 316 and SAE 304 stainless steel.

Figure 10:
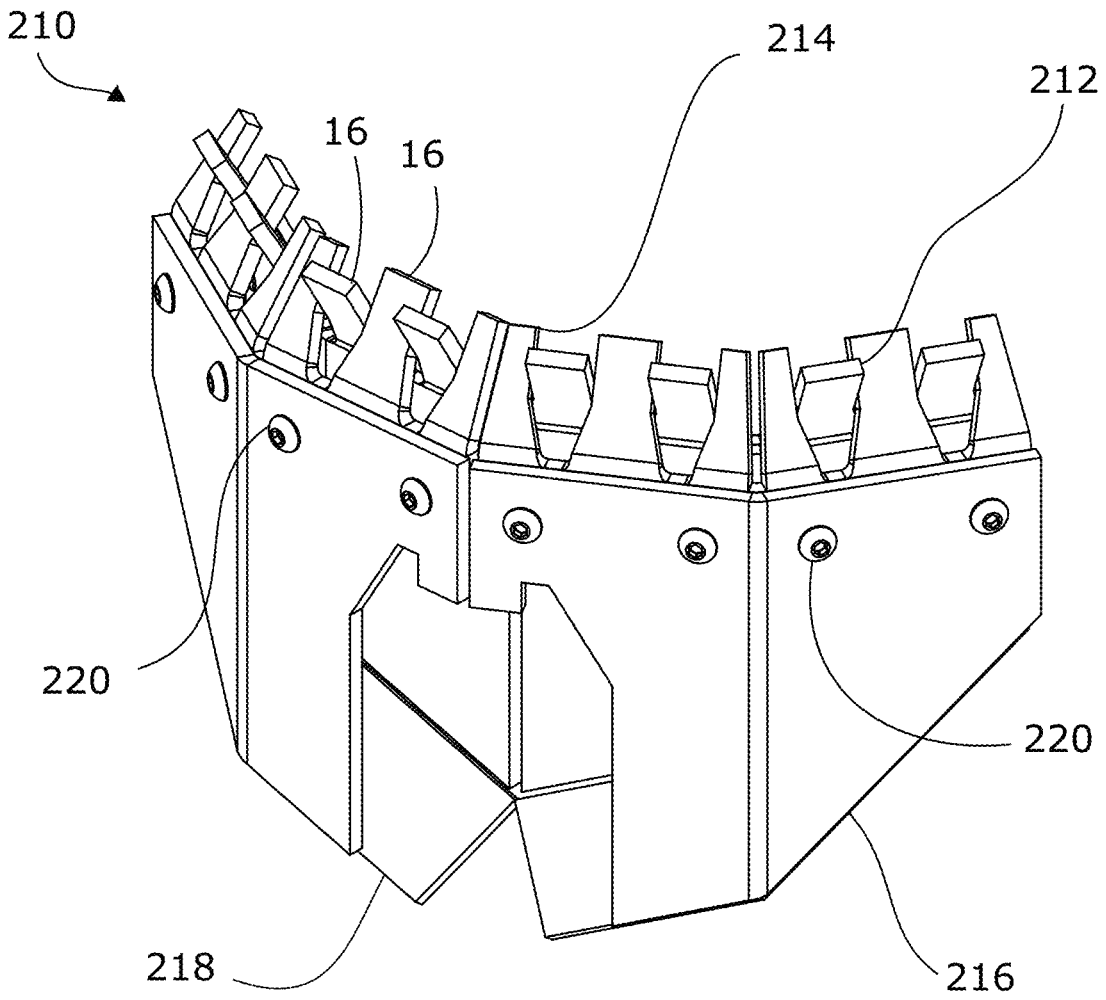
FIG. 10 is an isometric view of a replaceable diffuser tab.
Figure 11:
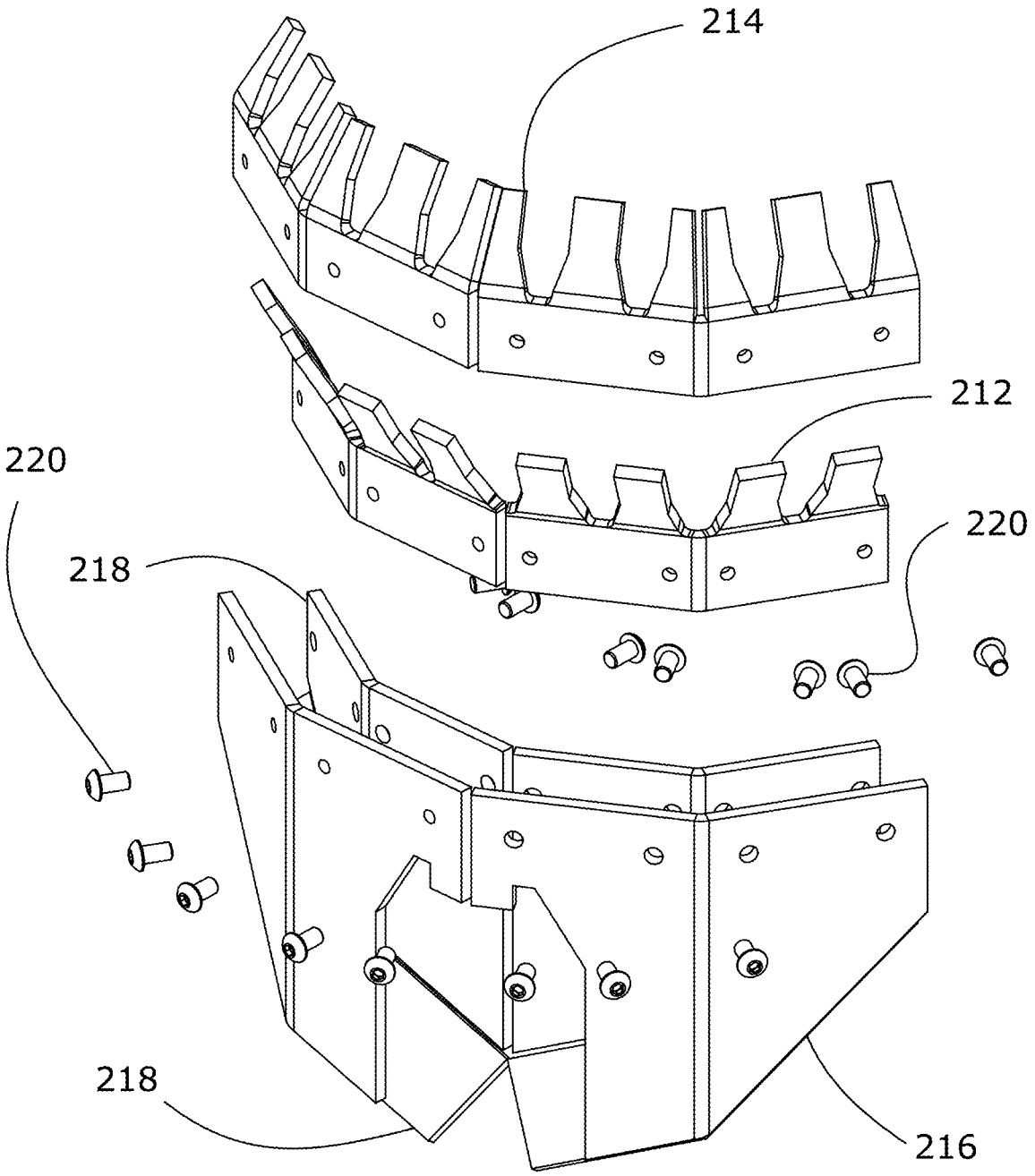
FIG. 11 is an exploded isometric view of the replaceable diffuser tab of FIG. 10.

FIGS. 10 and 11 show an embodiment of a replaceable diffuser tab arrangement 210. In the embodiment shown, three sets of replaceable diffuser tab arrangements 210 may be configured around a concentric diffuser ring 12, 112 and between spokes 30. An inner diffuser tab segment 212 may be fastened to an inner surface 218 of concentric diffuser ring 12, 112, and an outer diffuser tab segment 214 may be fastened to outer surface 216 of concentric diffuser ring 12, 112, using appropriate fasteners 220. The diffuser tab segments 212, 214 include interlaced teeth 16.

Replaceable diffuser tabs may permit tips to be made with more expensive materials than may otherwise be economically viable. Making them replaceable enables the use of higher grade materials only where required. In addition, where one or more of the replaceable diffuser tabs experiences greater deterioration during use than other replaceable diffuser tabs, those particular diffuser tabs can be replaced. This allows the user to avoid having to replace the whole flare stack diffuser tip when only a part of a tip has deteriorated.

The ports where gas exits the tip may be various shapes other than just square or rectangular openings. In some embodiments, the ports may be triangular which may allow for tuning the air/gas mixture depending on the molecular weight of the gas and the flow rates so it is optimized for each application.

In this document, although the word 'gas' is used to describe waste gas to be combusted, the term is intended to include any mix of fluids, including those that includes entrained liquid. The flare stack tip may be used for combustion waste fluids from industrial plants such as petroleum refineries, chemical plants and natural gas processing plants or at oil or gas extraction sites.

Immaterial modifications may be made to the embodiments described here without departing from what is covered by the claims. For example, although the radial transfer spokes are shown in this document as having a rectangular shape extending radially outward, the transfer spokes can have many different shapes and sizes as long as they extend sufficiently in the radial direction to connect between concentric diffuser rings. The radial transfer spokes could be spiral, rounded or any other shape. The concentric diffuser rings do not need to be circular in shape. In the embodiments shown in FIGS. 1-7, the concentric diffuser rings have the shape of a dodecagon, but various numbers of sides are possible including being circular. The concentric diffuser rings may not be symmetrical as long as they define a closed loop around the center of the flare stack diffuser tip without massive variations in the radius of the rings. The concentric diffuser rings be formed from a continuous coiled design having multiple loops so long as air can pass between the different sets of coils and mix with the waste gases from the concentric diffuser rings.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A flare stack diffuser tip for use with a flare stack having a waste gas conduit, the flare stack diffuser tip comprising:
- one or more concentric diffuser rings;
- one or more radial transfer spokes configured to connect to the waste gas conduit to receive waste gas and the one or more radial transfer spokes in fluid connection with the one or more diffuser rings; and
  - in respect of at least one concentric diffuser ring of the one or more concentric diffuser rings, inner teeth extending from a radially inner surface of the at least one concentric diffuser ring, outer teeth extending from a radially outer surface of the at least one concentric diffuser ring, the inner teeth and the outer teeth interlacing,
  - in which the inner teeth are mounted on inner replaceable tabs secured to the radially inner surface and the outer teeth are mounted on outer replaceable tabs secured to the radially outer surface.

2. The flare stack diffuser tip of claim 1 in which the radial transfer spokes define an open core permitting air flow through a central opening defined by the one or more diffuser rings.

3. The flare stack diffuser tip of claim 2 in which there is more than one concentric diffuser ring, each of the one or more transfer spokes further comprising a flame bridge extending between plural concentric diffusing rings.

4. The flare stack diffuser tip of claim 3 in which one or more radial transfer spokes each extend upwardly and outwardly at an upper end of the flare stack diffuser tip to define the open core.

5. The flare stack diffuser tip of claim 2 in which the one or more concentric diffusing rings are at least two concentric diffuser rings defining air flow passageways between them.

6. The flare stack diffuser tip of claim 5 in which the air flow passageways connect to the open core.

7. The flare stack diffuser tip of claim 1 comprising at least two radial transfer spokes.

8. The flare stack diffuser tip of claim 1 comprising three concentric diffuser rings.

9. The flare stack diffuser tip of claim 7 comprising three radial transfer spokes each equally angularly-spaced from each other.

* * * * *